US007901194B2

(12) United States Patent
Beers et al.

(10) Patent No.: US 7,901,194 B2
(45) Date of Patent: Mar. 8, 2011

(54) SHAFT COUPLING FOR SCROLL COMPRESSOR

(75) Inventors: Craig M. Beers, Wethersfield, CT (US); Peter J. Arseneaux, Glasonbury, CT (US); Darryl A. Colson, West Suffield, CT (US)

(73) Assignee: Hamilton Sundstrand Corporation, Rockford, IL (US)

( * ) Notice: Subject to any disclaimer, the term of this patent is extended or adjusted under 35 U.S.C. 154(b) by 518 days.

(21) Appl. No.: 12/082,171

(22) Filed: Apr. 9, 2008

(65) Prior Publication Data

US 2009/0257900 A1 Oct. 15, 2009

(51) Int. Cl.
*F01C 1/02* (2006.01)
*F03C 2/00* (2006.01)
*F03C 4/00* (2006.01)

(52) U.S. Cl. ..... 418/55.1; 418/55.5; 418/57; 418/182; 464/32; 464/182

(58) Field of Classification Search ..... 418/55.1–55.6, 418/57, 181, 182; 464/32, 182; 403/299, 403/342; 411/389, 432, 433, 366.1, 535
See application file for complete search history.

(56) References Cited

U.S. PATENT DOCUMENTS

| | | | | |
|---|---|---|---|---|
| 2,269,799 | A * | 1/1942 | Upson | 464/182 |
| 4,808,094 | A | 2/1989 | Sugimoto et al. | |
| 4,877,382 | A | 10/1989 | Caillat et al. | |
| 4,898,520 | A | 2/1990 | Nieter et al. | |
| 5,088,906 | A | 2/1992 | Richardson, Jr. | |
| 5,090,878 | A | 2/1992 | Haller | |
| 5,111,712 | A | 5/1992 | Kassouf et al. | |
| 5,242,282 | A | 9/1993 | Mitsunaga et al. | |
| 5,320,506 | A | 6/1994 | Fogt | |
| 5,407,335 | A | 4/1995 | Caillat et al. | |
| 5,452,995 | A | 9/1995 | Izumi et al. | |
| 5,496,158 | A | 3/1996 | Barito et al. | |
| 5,536,152 | A | 7/1996 | Kawahara et al. | |
| 5,580,228 | A * | 12/1996 | Ishikawa et al. | 418/55.2 |
| 5,580,230 | A | 12/1996 | Keifer et al. | |
| 5,846,042 | A * | 12/1998 | Iannuzzi | 411/120 |
| 5,931,649 | A | 8/1999 | Caillat et al. | |
| RE36,604 | E | 3/2000 | Sano et al. | |
| 6,273,616 | B1 | 8/2001 | Pflug | |
| 6,302,664 | B1 | 10/2001 | Kazakis et al. | |
| 6,361,296 | B1 | 3/2002 | Hirooka et al. | |
| 6,364,774 | B1 | 4/2002 | Kimura et al. | |
| 6,464,481 | B2 | 10/2002 | Tsubai et al. | |
| 6,506,036 | B2 * | 1/2003 | Tsubai et al. | 418/55.5 |
| 6,666,669 | B2 | 12/2003 | Suss | |
| 7,273,361 | B2 | 9/2007 | Park | |
| 7,322,807 | B2 | 1/2008 | Clendenin et al. | |
| 2005/0100397 | A1 * | 5/2005 | Enokijima et al. | 403/299 |
| 2007/0231178 | A1 | 10/2007 | Su et al. | |

FOREIGN PATENT DOCUMENTS

JP 11002194 A * 1/1999

* cited by examiner

*Primary Examiner* — Theresa Trieu
(74) *Attorney, Agent, or Firm* — Kinney & Lange, P.A.

(57) ABSTRACT

A coupling mechanism for a scroll compressor comprises an orbiting scroll disk, a retention bolt, a bearing shaft and a retention nut. The orbiting scroll disk includes a first face configured to engage a stationary scroll disk to compress a working fluid, and a second face having a hub. The retention bolt is inserted into the hub. The bearing shaft is fit onto the retention bolt and includes a bearing surface for engaging a drive bushing of a drive shaft. The retention nut is threaded onto the retention bolt to retain connection of the bearing shaft with the orbiting scroll disk.

21 Claims, 2 Drawing Sheets

SHAFT COUPLING FOR SCROLL COMPRESSOR

BACKGROUND

The present invention is directed to fluid compressors suitable for use with vapor-compression cycles and, more particularly, to shaft couplings for orbiting scroll compressors.

Orbiting scroll compressors utilize opposing scrolls to compress a working fluid between two disks along a spirally wound compression path. A stationary scroll includes a first disk having a first spiral wound flange facing an orbiting scroll. The orbiting scroll includes a second disk having a second spiral wound flange that intermeshes with the first spiral wound flange. The first and second spiral wound flanges are disposed between the first and second disks to form a spiral shaped flow path. The second scroll is offset from the first scroll such that the second flange contacts the first flange at intervals of approximately every half-winding of the flow path. As such, the orbiting scroll orbits around the center point of the stationary scroll such that fluid trapped between contact points of the flanges is compressed as it works its way from between the outer windings to between the inner windings as the radius of the windings and the volume of the flow path decrease.

In order to provide the orbiting action of the orbiting scroll, the second disk is connected to a drive shaft through a bearing shaft. The bearing shaft is connected to the drive shaft through a bearing socket having a central axis offset from a central axis of the drive shaft. As the drive shaft rotates about its central axis, the central axis of the bearing socket rotates about, or orbits, the central axis of the drive shaft. As the second flange of the orbiting scroll engages the first flange of the stationary scroll to compress the fluid along the flow path, rotation of the orbiting scroll about the central axis of the bearing shaft is prevented and the bearing socket rotates around the bearing shaft. Thus, the bearing socket and bearing shaft are subject to three-dimensional torque from the mechanical coupling of the drive shaft and the scroll, as well as from the pressure of the compressed fluid flowing through the flanges.

Due the different performance requirements of the scroll and the bearing shaft, it has been typical practice to fabricate the scroll and the bearing shaft from different materials. For example, scrolls are typically comprised of a relatively soft, lubricious material suitable for allowing contact between the flanges. Conversely, bearing shafts are typically comprised of relatively hard, wear-resistant materials suitable for engagement with bearings. It is generally cost-prohibitive to fabricate the scroll from bearing material and performance-prohibitive to fabricate the bearing shaft from scroll material. It therefore becomes necessary to join these components through a coupling that permits each component to function properly and that can withstand the forces transmitted during the compression process. Previous coupling designs have relied on the strength of a single, small diameter threaded fastener that extends through the bearing shaft and the orbiting scroll. The small diameter bolts of these designs are susceptible to breaking and produce stress concentrations within the orbiting scroll, thus limiting the operating speed and power of the compressor. As such, there is a need for a shaft coupling for use in an orbiting scroll compressor that provides suitable material performance and torque transmitting characteristics.

SUMMARY

The present invention is directed to a coupling mechanism for a scroll compressor. The coupling mechanism comprises an orbiting scroll disk, a retention bolt, a bearing shaft and a retention nut. The orbiting scroll disk includes a first face configured to engage a stationary scroll disk to compress a working fluid, and a second face having a hub. The retention bolt is inserted into the hub. The bearing shaft is fit onto the retention bolt and includes a bearing surface for engaging a drive bushing of a drive shaft. The retention nut is threaded onto the retention bolt to retain connection of the bearing shaft with the orbiting scroll disk.

DETAILED DESCRIPTION

Figure 1:
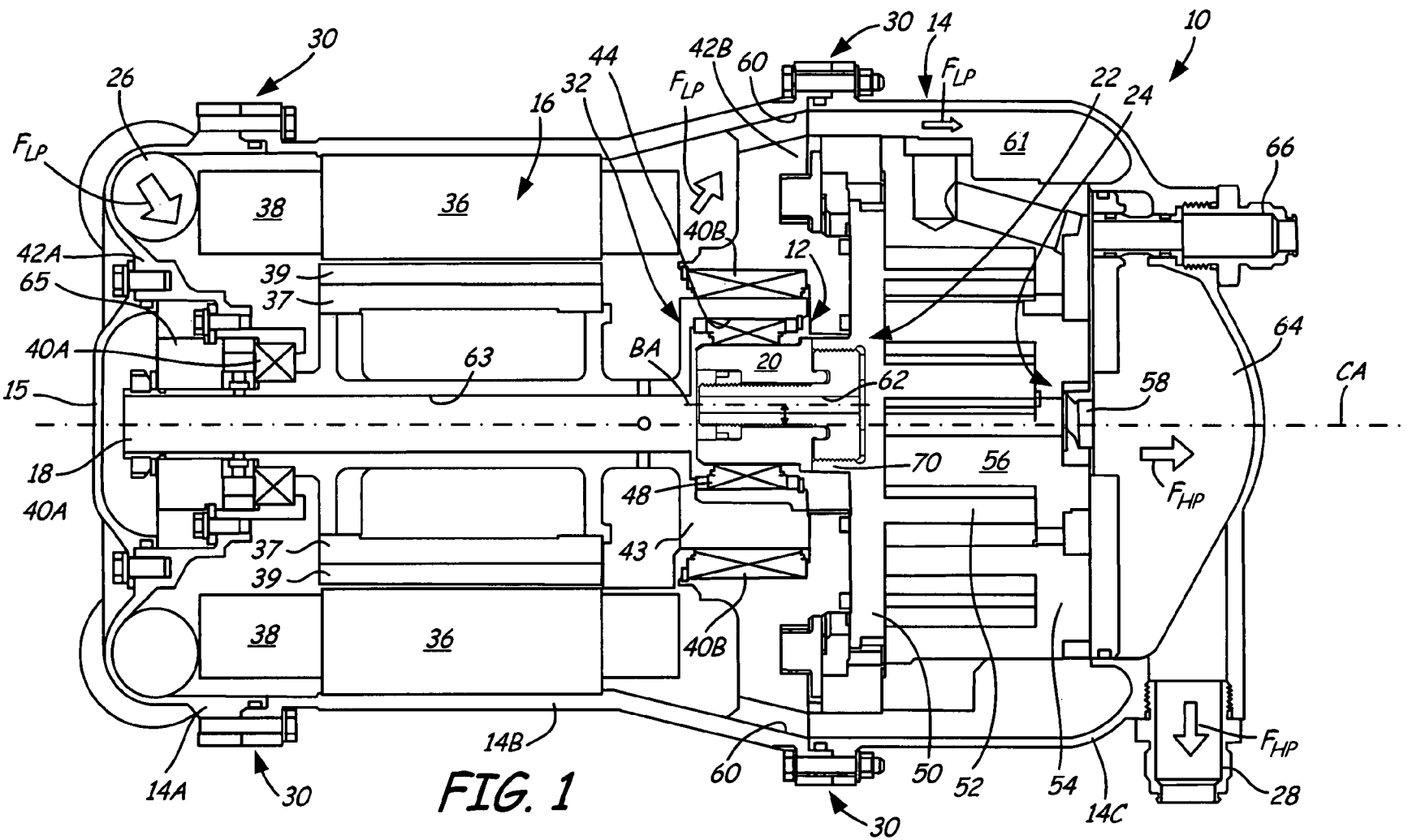
FIG. 1 shows a diagrammatic, cross sectional view of a scroll compressor in which a shaft coupling of the present invention is used to connect a drive shaft to an orbiting scroll.

FIG. 1 shows a cross sectional view of scroll compressor 10 having shaft coupling 12 of the present invention. Scroll compressor 10 includes hermetic shell 14, electric motor 16, drive shaft 18, bearing shaft 20, orbiting scroll 22 and stationary scroll 24. Shell 14 comprises a casing in which components of compressor 10 are hermetically sealed so that a fluid, such as a refrigerant, can be directed to scrolls 22 and 24 to be compressed in a contaminant-free environment. Scroll compressor 10 is configured to receive low pressure fluid $F_{LP}$ at inlet 26 of shell 14, compress the fluid utilizing stationary scroll 24 and orbiting scroll 22, which is driven by motor 16, and discharge high pressure fluid $F_{HP}$ at outlet 28 of shell 14. In the embodiment shown, shell 14 comprises three segments 14A, 14B and 14C connected at bolted flanges 30 to facilitate assembly and maintenance of compressor 10. Additionally, shell segment 14A includes cover 15 to provide access to motor 16 and shaft 18. Bearing shaft 20 joins coupler 32 of drive shaft 18 and hub 34 of orbiting scroll 22 so that drive shaft 18 is linked with orbiting scroll 22 within shell 14. Shaft coupling 12 of the present invention connects bearing shaft 20 with hub 34 to reduce stress concentrations within hub 34 and bearing shaft 20.

Electric motor 16 comprises an electromagnetic motor having stator 36 and rotor 37. In the embodiment shown, stator 36 includes wire windings 38 mounted to shell segment 14B, and rotor 37 includes a plurality of permanent magnets 39 mounted on drive shaft 18. Stator 36 and rotor 38 operate as is known in the art as a conventional electric drive motor to produce rotation of shaft 18 about central axis CA. In other embodiments, however, other types of drive motors may be used. Drive shaft 18 rotates on central axis CA within bearings 40A and bearings 40B, which are supported within shell 14 by struts 42A and 42B, respectively. Bearings 40A comprise ball bearings and are configured to ride directly on shaft 18 near shell segment 14A. Bearings 40B comprise roller bearings and are configured to support shaft 18 at coupler 32 near shell segment 14C. Shaft 18 extends from strut 42A at shell segment 14A, through electric motor 16 within shell segment 14B, to strut 42B at shell segment 14C. As such when, motor 16 is activated, such as when electric current is supplied to windings 38 of stator 36, rotor 37 is electromagnetically driven to rotate about central axis CA, causing drive shaft 18 to also rotate about central axis CA.

Coupler 32 comprises cylindrical head 43, which is positioned at an end of shaft 18 and includes bore 44. Head 43 is centered on shaft 18 such that head 43 rotates generally uniformly about central axis CA when drive shaft 18 rotates.

Bore 44, however, is positioned within head 43 such that bearing axis BA of bore 44 is offset a distance x from central axis CA. As such, the center of bore 44 and bearing axis BA orbit central axis CA when shaft 18 rotates. Bearing 48 is disposed within bore 44 and is configured to receive bearing shaft 20 such that the center of bearing shaft 20 also orbits central axis CA. In the embodiment shown, bearing 48 comprises a roller bearing, but in other embodiments other bearings or bushings may be used. Utilizing coupling 12 of the present invention, bearing shaft 20 joins hub 34 of orbiting scroll 22 with coupler 32 and drive shaft 18. Thus, coupler 32 operates as a cam to provide the orbiting motion that drives orbiting scroll 22 against stationary scroll 24.

Orbiting scroll 22 includes hub 34, orbiting disk 50, and orbiting scroll flange 52. Similarly, stationary scroll 24 includes stationary disk 54, stationary scroll flange 56 and reed valve 58. Stationary scroll 24 is mounted to shell segment 14C within compressor 10 through any suitable means as is known in the art such that stationary scroll 24 remains generally immobile during operation of compressor 10. Orbiting scroll 22 is supported by shaft 18 through the connection of bearing shaft 20 with hub 34 and coupler 32. Orbiting scroll 22 is positioned such that orbiting scroll flange 52 is inter-disposed with stationary scroll flange 56 to form a flow path having intermittent contact between flange 52 and flange 56. Flanges 52 and 56 comprise wraps that form a spiral compression path that winds from the outer diameters of disks 50 and 54 toward central axis CA. Stationary disk 54 is mounted to shell segment 14C such that an innermost portion of scroll flange 56 is generally aligned with central axis CA. Orbiting disk 50 is mounted on bearing shaft 20 such an innermost portion of scroll flange 54 is generally aligned with bearing axis BA. The offset distance x provides the gyrating action of orbiting disk 54 when shaft 18 rotates such that the center of scroll flange 52 orbits around central axis CA within scroll flange 56. Bearings 48 rotatably connect bearing shaft 20 with coupler 32 to prevent binding of orbiting flange 52 within stationary flange 56. Thus, bore 44 and bearings 48 rotate around bearing shaft 20 while the center of bearing shaft 20 orbits central axis CA on bearing axis BA. As such, orbiting scroll 22 and stationary scroll 24 operate conventionally to compress a fluid along the flow path.

Low pressure fluid $F_{LP}$ enters compressor 10 at inlet 28 at shell segment 14A. Low pressure fluid $F_{LP}$ flows into shell segment 14B and surrounds electric motor 16. Stator 36 and rotor 38 include passages or channels that permit low pressure fluid $F_{LP}$ to pass through motor 16. Low pressure fluid $F_{LP}$ flows through channels 60 and into shell segment 14C such that the fluid is disposed radially about scrolls 22 and 24 in suction chamber 61. Low pressure fluid $F_{LP}$ is sucked into the spiral flow path of flanges 52 and 56 by the orbiting action of scroll 22. From within the compression path, a small amount of compressed fluid is bled through small bores (not shown) in disk 50 to provide lubrication to bearings 40A, 40B and 48. Compressed fluid is pushed into interior channel 62 extending through bearing shaft 20 and then into bore 44 of coupler 32. From the outer periphery of bore 44, the compressed fluid winds through and lubricates bearings 40B and bearings 48 before being discharged into shell segment 14B. Additionally, from a center portion of bore 44, the compressed fluid exits coupler 32 and enters channel 63 within shaft 18 to lubricate bearings 40A, before discharging into shell segment 14B. The fluid returned to shell segment 14B from bearings 40A, 40B and 48 is recycled into the compression cycle where it is again delivered to suction chamber 61 and the compression flow path formed by flanges 52 and 56.

Orbiting scroll flange 52 engages stationary scroll flange 52 to compress and push low pressure fluid $F_{LP}$ toward central axis CA, whereby the fluid is discharged into pressure chamber 64 through reed valve 58 as high pressure fluid $F_{HP}$. Reed valve 58 discharges high pressure fluid $F_{HP}$ from scrolls 22 and 24 in pulsed bursts and prevents backflow of fluid into scrolls 22 and 24. Pressure chamber 64 also provides a damping chamber for attenuating the pulses of compressed high pressure fluid $F_{HP}$ released by reed valve 58. High pressure fluid $F_{HP}$ is pushed out of compressor 10 at outlet 28 in shell segment 14C whereby the compressed high pressure fluid $F_{HP}$ is available for use, such as in a vapor-compression system. In one embodiment of the invention, compressor 10 provides compressed refrigerant for use in an aircraft refrigeration and air conditioning system. Compressor 10 also includes other components, such as resolver 65 and economizer inlet 66, to facilitate operation of compressor 10 and the vapor-compression system.

Shaft 20 connects coupler 32 of shaft 18 to hub 34 such that orbiting scroll 22 is provided with the orbiting motion necessary to compress fluid with stationary scroll 24. As such, bearing shaft 20 is subjected to various three-dimensional loading due to the mechanical torque transmission from shaft 18 and the fluid compression process from scroll 22. For example, bearing shaft 20 is subject to bending forces from both bearings 48 and hub 34. Likewise, scroll flange 52 contacts scroll flange 56 to cause stress on disk 50 and hub 34. These various forces require different material properties for bearing shaft 20 and scroll 22. It is desirable for bearing shaft 20 to be comprised of a somewhat hard material suitable for engaging bearing 48. It is, however, desirable for scroll 22 to be comprised of a somewhat soft material to foster engagement of flanges 52 and 56. Coupling 12 of the present invention provides a mechanism that permits bearing shaft 20 and orbiting scroll 22 to be fabricated from materials that permit optimal performance of each component. Additionally, coupling 12 provides a mechanism that joins shaft 20 to hub 34 to prevent the formation of stress concentrations within orbiting scroll 22 and shaft 20.

Figure 2:
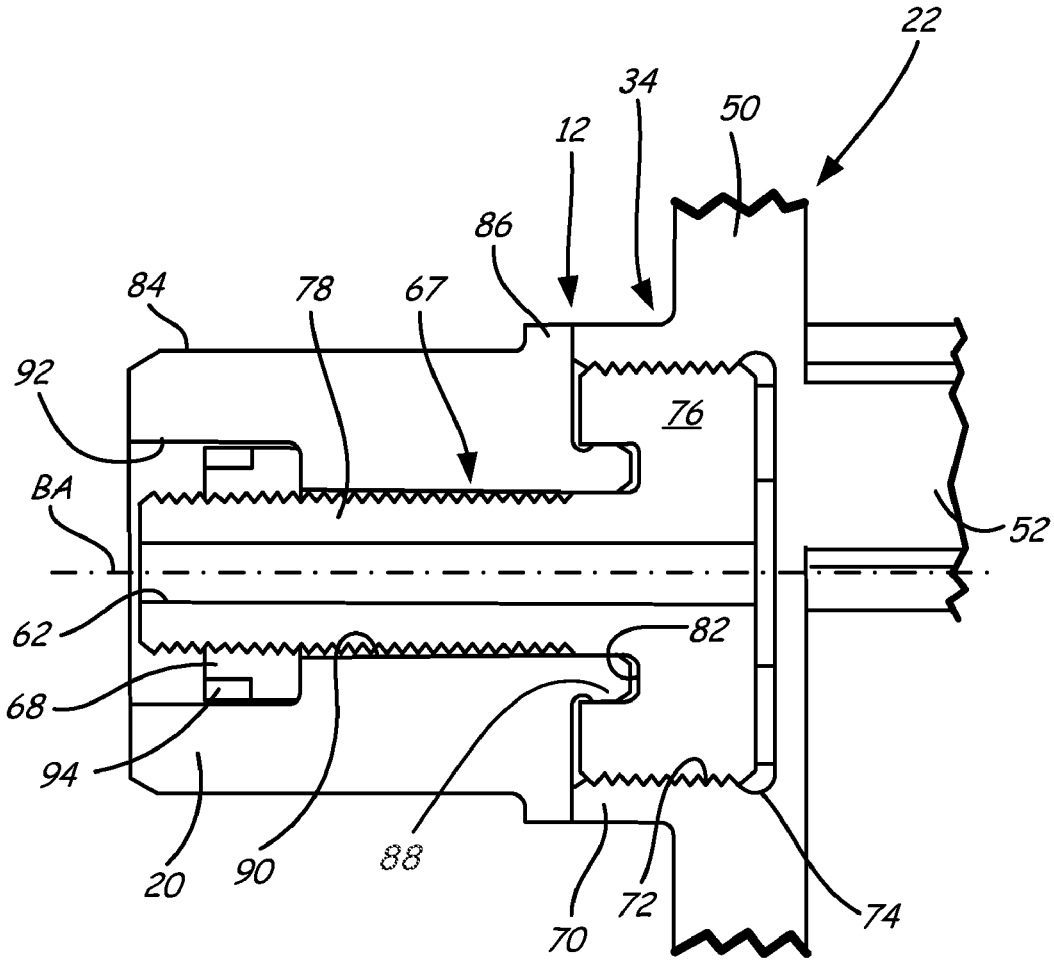
FIG. 2 shows a shaft coupling for connecting a bearing shaft with a scroll hub in the scroll compressor of FIG. 1.

FIG. 2 shows coupling 12 for connecting bearing shaft 20 with orbiting scroll 22. Coupling 12 includes bearing shaft 20, hub 34, disk 50, connector 67 and retainer 68. Hub 34 includes axial flange portion 70, socket 72 and notch 74. Connector 67 includes lubrication bore 62, head 76, shank 78 and axial recess 82. Shaft 20 includes bearing surface 84, radial flange 86, axial flange 88, assembly bore 90 and retainer bore 92. As described above, the center of orbiting scroll 22 is configured to orbit around central axis CA of drive shaft 18 (FIG. 1), while bearing 48 and bore 44 of coupler 32 (FIG. 1) rotate about bearing shaft 20. As such, shaft 20 is comprised of a somewhat hard material to transmit torque from shaft 18 to scroll 22 and to provide a durable bearing surface for bearing 48. Scroll 22 is, however, comprised of a somewhat pliable or supple material for engaging stationary scroll 24. Coupling 12 mechanically engages the disparate materials of shaft 20 and scroll 22, while distributing stress throughout the coupling.

Scroll 22 is configured to be mounted within compressor 10 such that orbiting scroll flange 52 interlocks with stationary scroll flange 56 to form a flow path for compressing a fluid. A first surface of disk 50 provides a portion of the flow path and seals the edges of flanges 52 and 56. A second surface of disk 50 includes socket 72, which joins disk 50 with bearing shaft 20. Axial flange 70 of socket 72 extends axially from disk 50 such that flange 70 is concentrically disposed about bearing axis BA. Similarly, socket 72 extends into disk 50 such that socket 72 is concentrically disposed about bearing axis BA. In one embodiment of the invention, socket 72 extends into disk 50 an approximate equal length as flange 70 extends out of disk 50. Flange 70 and socket 72 include threads on their interior facing surfaces to receive head 76 of connector 67.

Connector 67 comprises a T-shaped fastener or connector having head 76 and shank 78. Head 76 includes threads that mate with threads within flange 70 and socket 72 such that connector 67 is rigidly connected to hub 34. Head 76 is threaded into flange 70 and socket 72 such that the width of head 76 spans the transition region between flange 70 and socket 72. Shank 78 of connector 67 comprises a transition shaft that extends axially from head 76 along bearing axis BA. Shank 78 includes lubrication bore 62 to permit a lubrication fluid to flow through coupling 12. For example, lubrication bore 62 fluidly connects the second surface of scroll disk 50 with bore 44 of coupler 32 (FIG. 1). Axial recess 82 extends into head 76 concentrically about shank 78 and is configured to receive axial flange 88 of bearing shaft 20. Assembly bore 90 of bearing shaft 20 is positioned around shank 78 such that shank 78 extends into retainer bore 92. Bearing shaft 20 engages with connector 67 and hub 34 such that axial flange 88 enters axial recess 82 of connector 67 and radial flange 86 contacts axial flange 70 of hub 34. In one embodiment of the invention, axial flange 88 is press-fit or snap-fit into axial recess 82 to couple bearing shaft 20 with connector 67. Shank 78 includes threads such that retainer 68 can be fastened to connector 67. Retainer 68 comprises a nut having threads configured to mate with threads of shank 78 such that retainer 68 can be tightened onto shank 78 to push bearing shaft 20 into tight contact with hub 34 and scroll 22. Retainer 68 includes notches 94 such that a tool or machine can be employed to apply torque to retainer 68, particularly once retainer 68 is positioned within retainer bore 92. For example, in one embodiment of the invention, a push pole device is used to preload shank 78. A push pole or similar device applies pre-tension to shank 78 before positioning retainer 68 onto shank 78. When the pre-tension is relieved on shank 78, retainer 68 is pulled straight into retainer bore 92 to engage bearing shaft 20 and secure retainer 68 with a more pure axial tension, avoiding production of twisting or three-dimensional torsional stresses in shaft 20 and shank 78, and avoiding forces that can loosen retainer 68. Because of the threaded engagement between head 76, flange 70 and socket 72, stress from retainer 68 is dispersed over a wide surface area of hub 34, rather than being concentrated on scroll 22. Thus, shank 78 assists in transitioning the tension applied by retainer 68 into hub 34. In one embodiment, shank 78 is preloaded with ten thousand pounds of tension.

Connector 67 of coupling 12 brings bearing shaft 20 into a rigid and solid engagement with scroll 22 to distribute loading and to minimize stress concentrations within hub 34. The threaded engagements between connector 67, hub 34 and retainer 68 inhibit separation between shaft 20 and scroll 22, thus preventing damage to axial flange 70 and radial flange 86. The diameters of head 76 and hub 34 are sized to be nearly as large as the diameter of shaft 20 such that stresses generated at the interface are spread over a large surface area. The diameter of shank 78 is, however, smaller such that the structural integrity of bearing shaft 20 is not compromised. Head 76 is seated within hub 34 such that head 76 contacts both flange 70 and socket 72 to avoid the creation of stress concentrations within scroll 22. For example, socket 72 is recessed into disk 50 to prevent flange 72 from bearing all of the bending stresses applied to shaft 20 from coupler 32. Socket 72 also includes notch 74, which extends concentrically around bearing axis BA where socket 72 and disk 50 converge, to provide stress relief within scroll 22. Socket 72 distributes loading into disk 50, which has a greater thickness and mass than flange 70. Flange 70, however, enables the depth of socket 72 to be greater than is the thickness of disk 50 such that additional surface area is provided for engagement with head 76 of connector 67. The depth of socket 72, including flange 70, is greater than the thickness of head 76. Head 76 is not completely threaded into socket 72 such that head 76 does not contact disk 50 where it is thinned to form socket 72. Head 76 is, however, threaded far enough into socket 72 such that head 76 is completely recessed into socket 72. Head 76 is inserted into socket 72 such that axial flange 88 of shaft 20 is able to engage axial recess 82, and radial flange 86 of shaft 20 is able to engage flange 70, enhancing the stability of coupling 12. Radial flange 86 contacts axial flange 70 to provide radial stability to bearing shaft 20 and prevent bending stresses. Axial flange 88 inhibits axial movement of bearing shaft 20.

In one embodiment of the invention, bearing shaft 20 is comprised of hardened steel, such as a tool steel, to provide a smooth and durable surface upon which bearings 48 can rotate. Such steels are, however, expensive, making fabrication of scroll 22 infeasible. Furthermore, machining such steels also requires expensive manufacturing processes that further increase the cost of producing scroll 22 from tool steel. Additionally, it is desirable that scroll 22 be comprised of a relatively softer, more lubricious material. Thus, in one embodiment of the invention, scroll 22 is comprised of a cast material, such as cast iron. Cast iron and other materials of similar hardness provide a measure of self-lubrication in that they are able to yield or deform to absorb small amounts of contact with stationary scroll 24, such as binding arising from imperfections in the oscillation of orbiting scroll 22. Scroll 22 can also be produced to include graphite to further facilitate lubricity. Connector 67 can be comprised of any suitable material for providing a threaded engagement with hard and soft materials, such as a 400 series steel.

The shaft coupling of the present invention achieves a sturdy connection between a bearing shaft and an orbiting scroll. The shaft coupling includes a transition connector that distributes stress concentrations within a hub of the orbiting scroll. The transition connector pulls the bearing shaft into tight engagement with the orbiting scroll. The transition connector includes a large diameter head that distributes loading within the hub over a large surface area. The head engages both a flange portion and a socket portion of the hub to prevent stress concentrations from forming within the orbiting scroll. The transition connector can also be pre-tensioned to reduce torsional stresses in the bearing shaft. Furthermore, the transition connector permits the bearing shaft and the orbiting scroll to be produced from materials suitable for optimizing performance of each component.

Although the present invention has been described with reference to preferred embodiments, workers skilled in the art will recognize that changes may be made in form and detail without departing from the spirit and scope of the invention.

The invention claimed is:

1. An orbiting scroll assembly for a scroll compressor, the orbiting scroll assembly comprising:

an orbiting scroll comprising:

a disk body;

a wrap disposed on a first surface of the disk for compressing a working fluid; and a hub disposed on a second surface of the disk for connecting with a drive shaft;

a connector comprising:

a head connected to the hub; and a shank extending from the head;

a bearing shaft comprising:

an annular body having an assembly bore disposed within the bearing shaft;

an axial flange engaged with the head; and a radial flange engaged with the hub; and a retention nut connected to the shank to maintain the bearing shaft connected to the head and the hub.

2. The orbiting scroll assembly of claim 1 wherein the hub comprises:

a socket depressed into the second surface of the disk body;

an axial hub flange extending from the second surface and surrounding the socket; and a stress relief notch extending into the disk at a base of the socket.

3. The orbiting scroll assembly of claim 2 wherein the head of the connector extends into the socket such that a first portion of the head engages a portion of the socket adjacent the disk and a second portion of the head engages the axial hub flange.

4. The orbiting scroll assembly of claim 2 wherein the radial flange of the bearing shaft engages the axial hub flange.

5. The orbiting scroll assembly of claim 1 wherein the connector comprises:

an axial socket extending into the head and surrounding the shank and configured to receive the axial flange of the bearing shaft.

6. The orbiting scroll assembly of claim 5 wherein:

the head of the connector is threaded into the hub of the orbiting scroll;

the retention nut is threaded onto the shank of the connector; and the axial flange of the bearing shaft is press-fit into the axial socket of the connector.

7. The orbiting scroll assembly of claim 1 wherein:

the bearing shaft is comprised of a hardened tool steel; and the scroll is comprised of cast iron.

8. The orbiting scroll assembly of claim 1 wherein the connector includes a lubrication bore extending through the shank and the head to facilitate transmission of lubrication from the orbiting scroll through the bearing shaft.

9. The orbiting scroll assembly of claim 1 wherein the bearing shaft further includes a counterbore encircling the assembly bore into which the retention nut is recessed.

10. The orbiting scroll assembly of claim 9 wherein the retention nut includes a socket for receiving a tensioning tool.

11. A coupling mechanism for a scroll compressor, the coupling mechanism comprising:

an orbiting scroll disk having:

a first face configured to engage a stationary scroll disk to compress a working fluid; and a second face having a hub;

a retention bolt inserted into the hub;

a bearing shaft fit onto the retention bolt, the shaft including a bearing surface for engaging a drive shaft; and a retention nut threaded onto the retention bolt to retain connection of the bearing shaft with the orbiting scroll disk.

12. The coupling mechanism of claim 11 wherein the retention bolt comprises:

a bolt head threaded into the hub;

a bolt shaft extending from the head; and a retention channel in the bolt head encircling the bolt shaft.

13. The coupling mechanism of claim 12 wherein the retention bolt includes a central bore extending through the bolt shaft and the bolt head to conduct lubrication from the orbiting scroll to the bearing surface.

14. The coupling mechanism of claim 12 wherein the bearing shaft comprises:

an annular body disposed about the bearing shaft;

an axial flange force fit into the retention channel;

a radial flange engaged with the hub; and an aft recess for receiving the retention nut.

15. The coupling mechanism of claim 14 wherein the hub comprises:

a hub socket partially recessed into the second face of the orbiting scroll; and a hub flange extending from the second face of the orbiting scroll;

wherein the head of the retention bolt extends partially across the hub socket and partially across the hub flange; and wherein the radial flange of the bearing shaft rests against the hub flange.

16. The coupling mechanism of claim 15 wherein the socket includes a stress relief notch extending into the disk at a base of the hub.

17. The coupling mechanism of claim 11 wherein the retention bolt is pre-tensioned such that there is substantially an absence of twisting stresses in the bolt shaft.

18. The coupling mechanism of claim 11 wherein the retention nut puts the bearing shaft into compression between the retention nut and the orbiting scroll and puts the bolt shaft into tension between the retention nut and the orbiting scroll.

19. The coupling mechanism of claim 11 wherein:

the bearing surface is comprised of a material having a hardness that provides a wear resistant bearing surface; and the orbiting scroll disk is comprised of a material having a hardness that provides a lubricious scroll interface.

20. A method for connecting a bearing shaft with an orbiting scroll disk hub in a scroll compressor, the method comprising:

threading a head of a connector into the hub on the orbiting scroll disk;

inserting a shank of the connector into a central bore within the bearing shaft;

press fitting a forward portion of the bearing shaft into a recess within the head of the connector such that the bearing shaft engages the hub; and threading a retention nut onto the shank of the connector to force the bearing shaft against the hub.

21. The method of claim 20 and further comprising the step of pre-tensioning the shank before threading the retention nut onto the shank to facilitate elimination of torsional stress within the connector.

* * * * *